US011725789B2

(12) United States Patent
Fox et al.

(10) Patent No.: US 11,725,789 B2
(45) **Date of Patent: *Aug. 15, 2023**

(54) MOUNTING AND JUNCTION BOX

(71) Applicant: Fox Hardwood Lumber Company, L.L.C., Franklin, TN (US)

(72) Inventors: Samuel Fox, Franklin, TN (US); Tommy Fox, Franklin, TN (US)

(73) Assignee: FOX HARDWOOD LUMBER COMPANY, L.L.C., Franklin, TN (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/865,521

(22) Filed: Jul. 15, 2022

(65) Prior Publication Data

US 2022/0349538 A1 Nov. 3, 2022

Related U.S. Application Data

(63) Continuation-in-part of application No. 17/508,557, filed on Oct. 22, 2021, now abandoned, which is a continuation of application No. 16/739,275, filed on Jan. 10, 2020, now Pat. No. 11,156,331.

(51) Int. Cl.
*F21S 8/04* (2006.01)
*F21S 8/06* (2006.01)

(52) U.S. Cl.
CPC ..... *F21S 8/043* (2013.01); *F21S 8/063* (2013.01)

(58) Field of Classification Search
CPC .... F21S 8/063; F21S 8/043; F21S 8/06; F21S 8/04
See application file for complete search history.

(56) References Cited

U.S. PATENT DOCUMENTS 11,028,982 B2 * 6/2021 Danesh ..... F21V 21/048
11,156,331 B2 * 10/2021 Fox ..... F21V 23/001

* cited by examiner

*Primary Examiner* — Anabel Ton
(74) *Attorney, Agent, or Firm* — Shane Cortesi

(57) ABSTRACT

Mounting boxes for overhead beams, such as purlins, of a building are described. The mounting box may include a front side that is designed to attach to a lateral side of the beam, an upper portion bottom that may rest on the horizontal beam, and a lower portion bottom that may have or be connected to a lighting socket or other electrical device.

28 Claims, 13 Drawing Sheets

MOUNTING AND JUNCTION BOX

BACKGROUND

Technical Field

The present invention relates to mounts designed to attach to roofing structures such as a beam in a metal industrial or commercial building, for example.

Background of the Invention

Various devices are known in the art that connect a light to a support structure. For example, Irish Wire Product Ltd sells a product called Loft Light for Attics by Loftleg, which is for mounting a light to a wooden beam that supports the ceiling of a dwelling or home. See https://www.irishwire-.com/merchant-product/loft-light. However, such a device is ill-suited for beams that are not made of wood.

Therefore, there exists a need for a new mounting box for attachment to beams. Preferably, the box facilitates the connection to the beam, providing a secure overhead light for a commercial building, such as a warehouse. Preferably, the interior of the box is easily accessible, allowing for easier installation to the beam or other support structure and also accessibility to the contents of the box interior such as electrical wiring.

SUMMARY OF THE INVENTION

The present disclosure provides mounting boxes for attaching electrical and other devices, such as light bulbs, cameras, alarms, heaters, and fans, to beams as described herein.

In some embodiments, the present disclosure provides a method of mounting a box to a beam of a building. The method may comprise providing a building comprising a beam. The beam may comprise a beam lateral side and a beam bottom side. The method may also comprise providing a box comprising an upper portion and a lower portion. The upper portion may comprise an upper portion front side, an upper portion rear side, an upper portion width extending from the upper portion front side to the upper portion rear side, an upper portion left side, an upper portion right side, an upper portion length extending from the upper portion left side to the upper portion right side and the length may be generally perpendicular to the upper portion width, an upper portion top side, an upper portion bottom side that may be oriented generally perpendicular to the upper portion front side, an upper portion height extending from the upper portion top side to the upper portion bottom side and the height may be generally perpendicular to the upper portion width and length. The lower portion may comprise a lower portion front side, a lower portion rear side, a lower portion width extending from the lower portion front side to the lower portion rear side, a lower portion left side, a lower portion right side, a lower portion length extending from the lower portion left side to the lower portion right side and the length may be generally perpendicular to the lower portion width, and a lower portion bottom side that may be located below the upper portion bottom side. Optionally, the lower portion front side is indented relative to the upper portion front side. Optionally, the upper portion bottom side and the lower portion front side form a i) corner having an angle of approximately 90 degrees and ii) a recess. Optionally, the method also comprises positioning the upper portion front side so that it faces the beam lateral side, more preferably, so that it is against the beam lateral side (i.e., at least a portion of the upper portion front side against the beam lateral side). Optionally, the method also comprises attaching the box to the beam using a fastener. For example, optionally, the method also comprises attaching the box to the beam using a fastener by attaching the upper portion front side to the beam lateral side.

Optionally, the upper portion front side comprises a generally circular fastener hole. Optionally, the lower portion bottom side comprises a light bulb socket extending generally downwardly from the lower portion bottom side. Optionally, the method further comprises placing a light bulb in the light bulb socket. Optionally, the box further comprises a box interior comprising electrical wiring powering the light bulb socket. Optionally, the upper portion left side and the upper portion right side each comprise a hole and optionally, the electrical wiring passes through the holes in the upper portion left side and upper portion right side and to the light bulb socket. Optionally, the lower portion left side and the lower portion right side each comprise a hole and optionally the electrical wiring passes through the holes in the lower portion left side and lower portion right side. Optionally, the upper portion front side and lower portion front side are generally flat. Optionally, the upper portion rear side comprises a slanted roof, the slanted roof angled at an angle of between about 10 degrees and 80 degrees relative to the upper portion front side. Optionally, the slanted roof is in the form of a removable plate. Optionally, the box is generally L-shaped. Optionally, the box comprises a generally hollow interior. Optionally, the recess is generally rectangular in shape. Optionally, the lower portion bottom side comprises a hole. Optionally, the box comprises at least one chamfered edge. Optionally, the box is in the form of a housing. Optionally, the box is comprised of metal. Optionally, the method further comprises joining a light bulb to the lower portion bottom side.

In still further embodiments, the present disclosure provides a box configured to mount to a beam of a building, the box comprising an upper portion and a lower portion. The upper portion may comprise an upper portion generally flat front side comprising at least one generally circular fastener hole, an upper portion rear side, an upper portion width extending from the upper portion front side to the upper portion rear side, an upper portion left side, an upper portion right side, an upper portion length extending from the upper portion left side to the upper portion right side and the length may be generally perpendicular to the upper portion width, an upper portion top side, an upper portion generally flat bottom side that may be oriented generally perpendicular to the upper portion front side, an upper portion height extending from the upper portion top side to the upper portion bottom side and the height may be generally perpendicular to the upper portion width and length. The lower portion may comprise a lower portion generally flat front side, a lower portion rear side, a lower portion width extending from the lower portion front side to the lower portion rear side, a lower portion left side, a lower portion right side, a lower portion length extending from the lower portion left side to the lower portion right side and the length may be generally perpendicular to the lower portion width, and a lower portion bottom side located below the upper portion bottom side. Optionally, the front side of the lower portion is indented relative to the front side of the upper portion. Optionally, the bottom of the upper portion and the front side of the lower portion form a corner having an angle of approximately 90 degrees and form a recess. Optionally, the bottom side of the lower portion comprises a light bulb socket extending generally downwardly from the bottom side of the lower portion.

Optionally, the box comprises a box interior. Optionally, the upper portion left side and the upper portion right side each comprise a hole. Optionally, electrical wiring is configured to pass through the upper portion left side into the box interior to the bulb socket and out the upper portion right side. Optionally, the box comprises a box interior. Optionally, the lower portion left side and the lower portion right side each comprise a hole. Optionally, electrical wiring is configured to pass through the lower portion left side into the box interior to the bulb socket and out the lower portion right side. Optionally, the at least one generally circular fastener hole is configured to hold a fastener. Optionally, the upper portion generally flat front side is configured to confront against a side of a beam.

BRIEF DESCRIPTION OF THE DRAWINGS

in FIG. 4, the mounting box is detached from the beam.

in FIG. 5, the mounting box is detached from the beam.

in FIG. 6, the mounting box is detached from the beam.

in FIG. 6A, the mounting box is detached from the beam.

in FIG. 7, the mounting box is detached from the beam.

in FIG. 8, several components are removed for clarity.

in FIG. 9, the slanted roof of the mounting box is removed.

in FIG. 10, the mounting box is detached from the beam.

in FIG. 11 electrical wiring passes through the mounting box.

DETAILED DESCRIPTION

Figure 1:
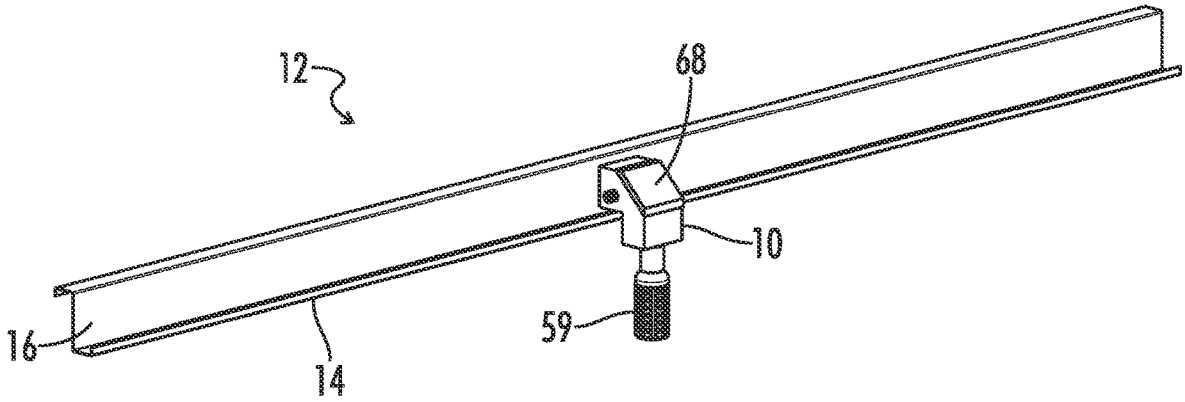
FIG. 1 illustrates a perspective view of a mounting box of one embodiment of the present invention attached to a beam of a building.

With references to FIGS. 1-23, the present invention provides a mounting box system designated by the numeral 10. In the drawings, not all reference numbers are included in each drawing for the sake of clarity. The drawings in FIGS. 1-23 are engineering drawings, drawn to scale. However, it will be understood that other proportions of the components are possible.

Referring further to FIGS. 1-23 the box 10 may be configured to mount to a beam 12 of a building. Preferably, the beam 12 is an overhead beam. More preferably, the beam 12 is an overhead horizontal beam, e.g., a purlin. The beam 12 may include a lateral side 16, a bottom side 14 and a lip 17. It will be understood that the singular embraces the plural. Thus, for example, the beam 12 may include two lateral sides 16. Optionally, the beam 12 is made out of metal.

Figure 3:
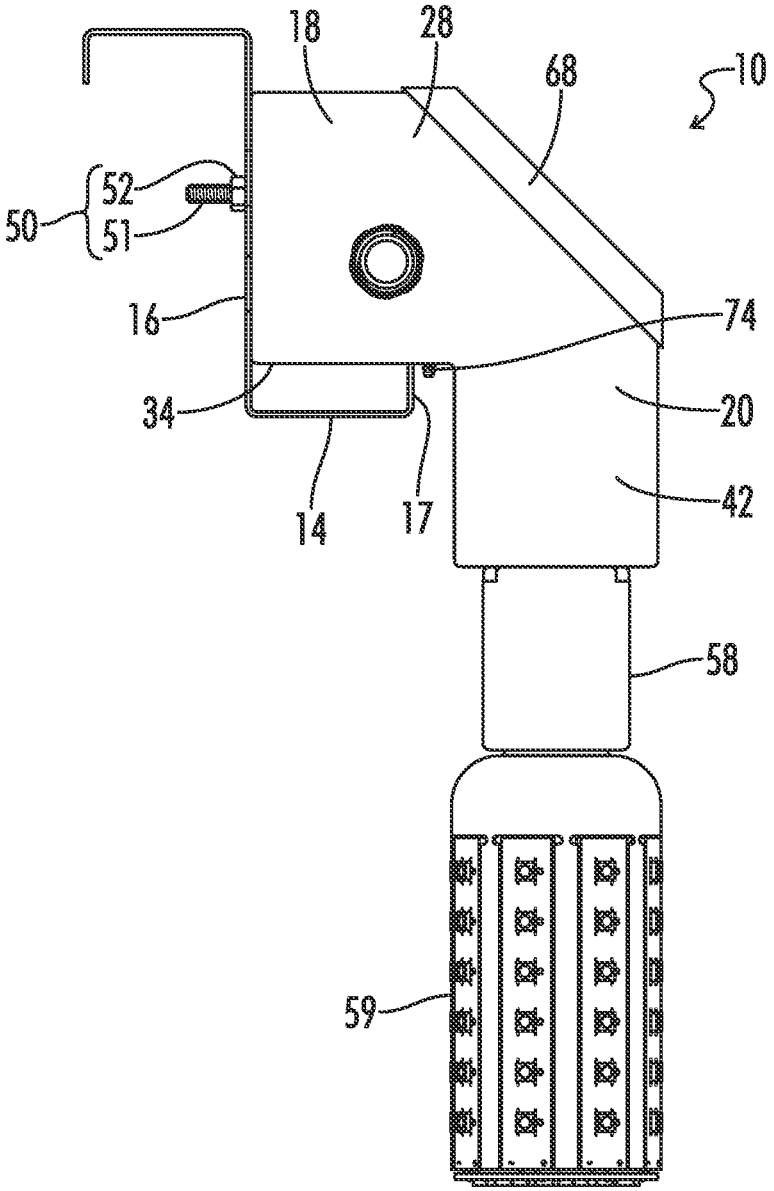
FIG. 3 illustrates a side elevation view of the mounting box and beam of FIG. 1.
Figure 4:
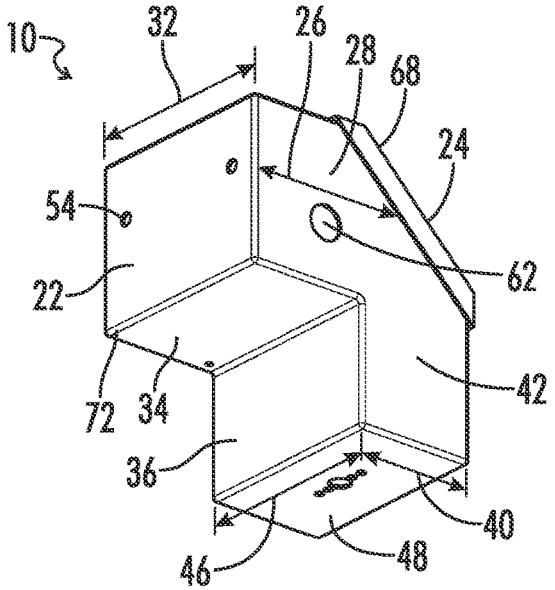
FIG. 4 illustrates a bottom perspective view of the mounting box of FIG. 1.

As shown in FIGS. 1-23, the box 10 may include an upper portion 18 and a lower portion 20. As best seen in FIG. 4, the upper portion 18 may include an upper portion front side 22, an upper portion rear side 24, and an upper portion width 26 (which be variable due to slanted roof 68, described below) extending from the upper portion front side 22 to the upper portion rear side 24. The upper portion 18 may further include an upper portion left side 28, an upper portion right side 30, and an upper portion length 32 extending from the upper portion left side 28 to the upper portion right side 30 and generally perpendicular to the upper portion width 26. The upper portion 18 may further include an upper portion top side 33, an upper portion bottom side 34 that may be oriented generally perpendicular to the upper portion front side 22, and an upper portion height 35 extending from the upper portion top side 33 to the upper portion bottom side 34 and generally perpendicular to the upper portion width 26 and length 32.

Figure 5:
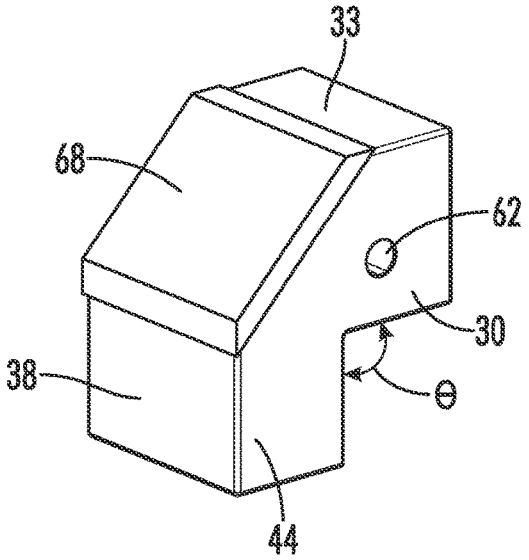
FIG. 5 illustrates a rear perspective view of the mounting box of FIG. 1.
Figure 6A:
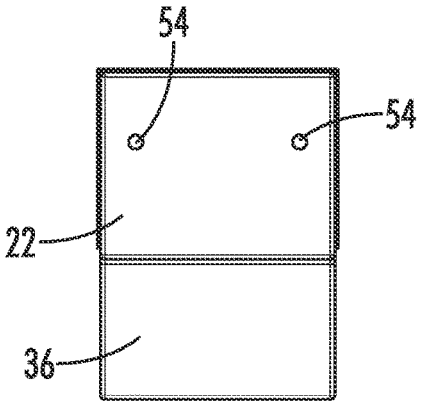
FIG. 6A illustrates a front elevation view of the mounting box of FIG. 1.
Figure 6:
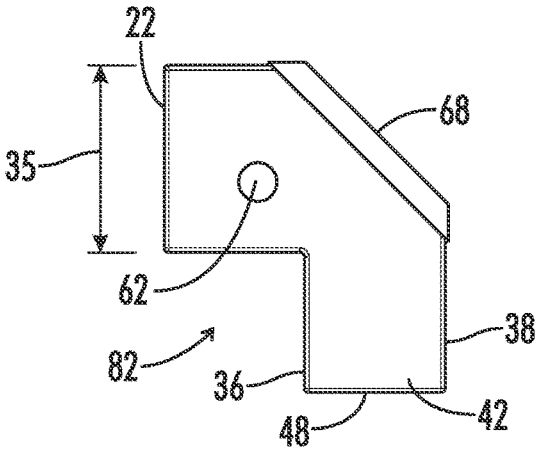
FIG. 6 illustrates a left side elevation view of the mounting box of FIG. 1.
Figure 7:
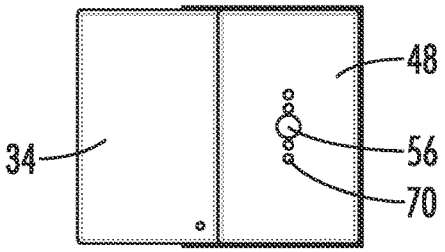
FIG. 7 illustrates a bottom plan view of the mounting box of FIG. 1.
Figure 8:
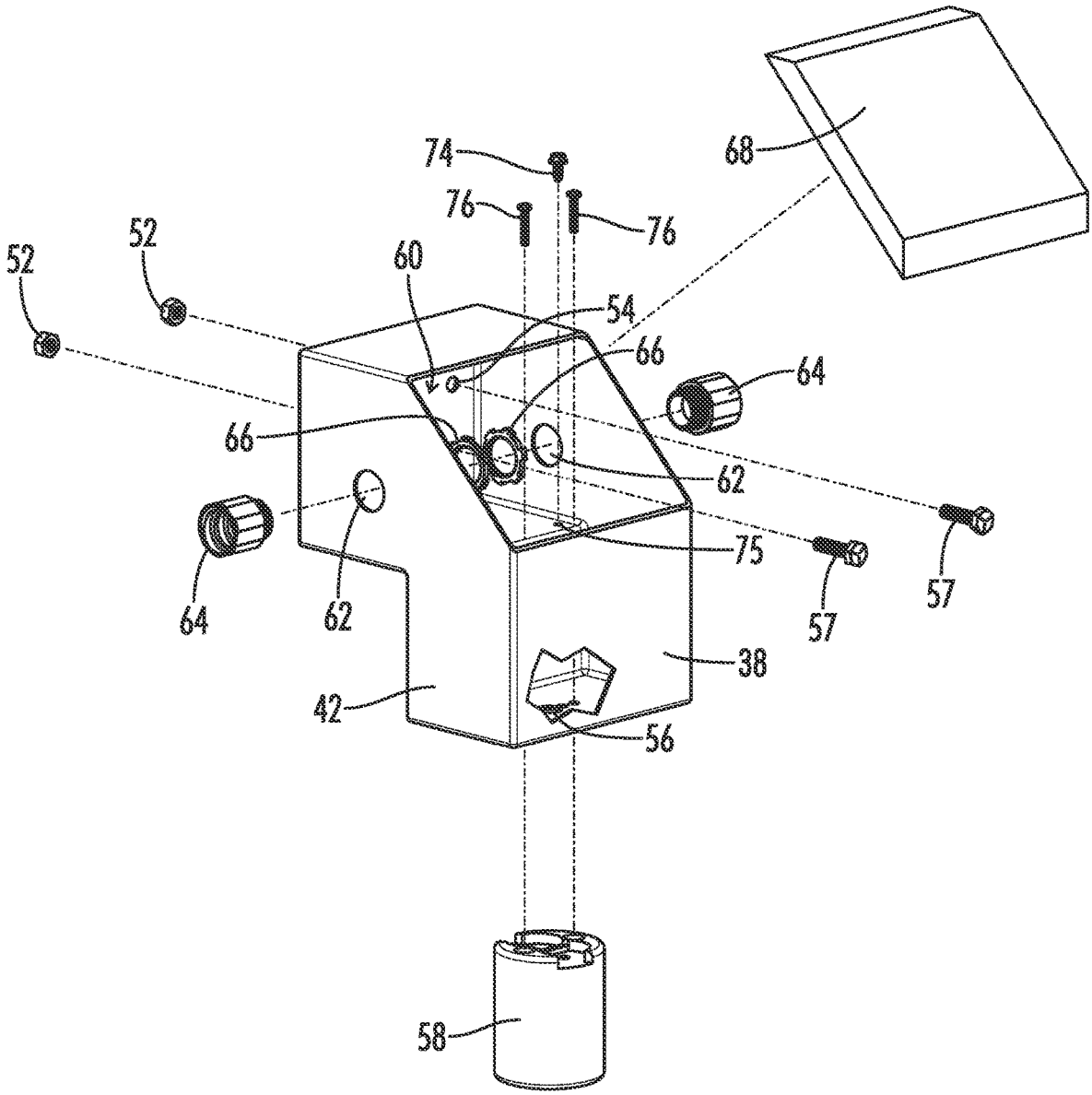
FIG. 8 illustrates an exploded left side perspective view of the mounting box of FIG. 1.

As best seen in FIGS. 4 and 5, the lower portion 20 may include a lower portion front side 36, a lower portion rear side 38, and a lower portion width 40 extending from the lower portion front side 36 to the lower portion rear side 38. The lower portion 20 may further include a lower portion left side 42, a lower portion right side 44, a lower portion length 46 extending from the lower portion left side 42 to the lower portion right side 44 and generally perpendicular to the lower portion width 40. The lower portion 20 may further include a lower portion bottom side 48 located below the upper portion bottom side 34. The lower portion front side 36 may be indented relative to the upper portion front side 22. The upper portion bottom side 34 and the lower portion front side 36 may form a corner having an angle (denoted by θ in FIG. 5) of approximately 90 degrees as well as a recess 82.

Figure 2:
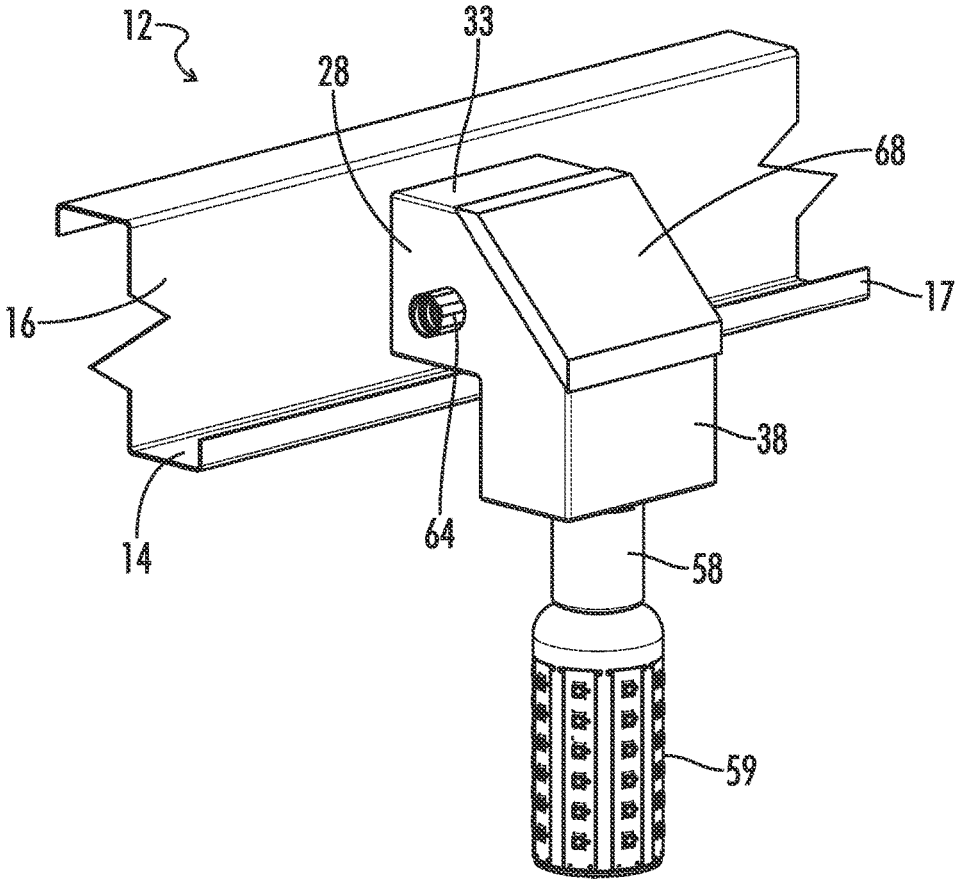
FIG. 2 illustrates another perspective view of the mounting box and beam of FIG. 1.

The upper portion front side 22 may be positioned against (and preferably attach to) the beam lateral side 16 and the upper portion bottom side 34 may rest on the beam 12. For example, the upper portion bottom side 34 may be positioned against the beam lip 17, as shown in FIGS. 1-3 and 10 for example, and/or the beam bottom side 14. The box 10 may be attached to the beam 12 using a fastener 50, as best seen in FIG. 3. Although the fastener 50 is exemplified by a threaded bolt 51 and threaded washer 52 in the exemplary embodiments, any suitable fastener may be used.

Optionally, as best seen in FIGS. 3 and 4, the upper portion front side 22 may include a generally circular fastener hole 54. Optionally, the upper portion front side 22 may be attached to the beam lateral side 16 by positioning the fastener 50 through the generally circular fastener hole 54 and into the beam lateral side 16.

Figure 12:
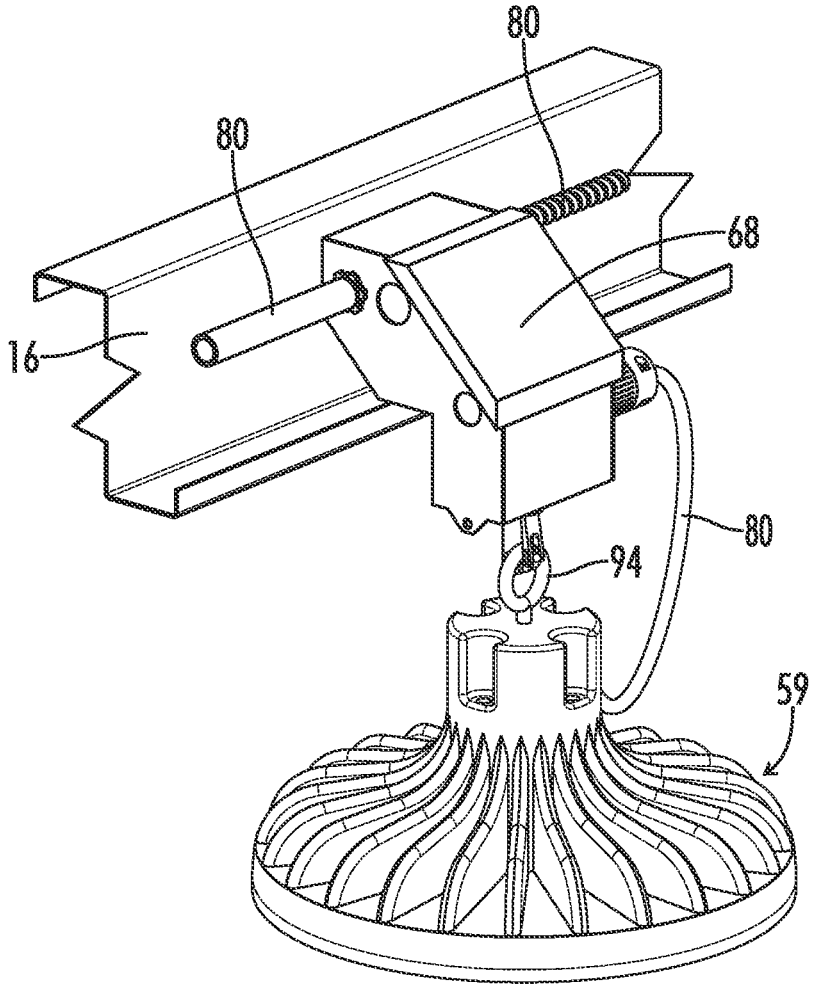
FIG. 12 illustrates a perspective view of the mounting box, electrical wiring and beam of FIG. 11 with a UFO light attached to the lower portion bottom side of the mounting box.
Figure 13:
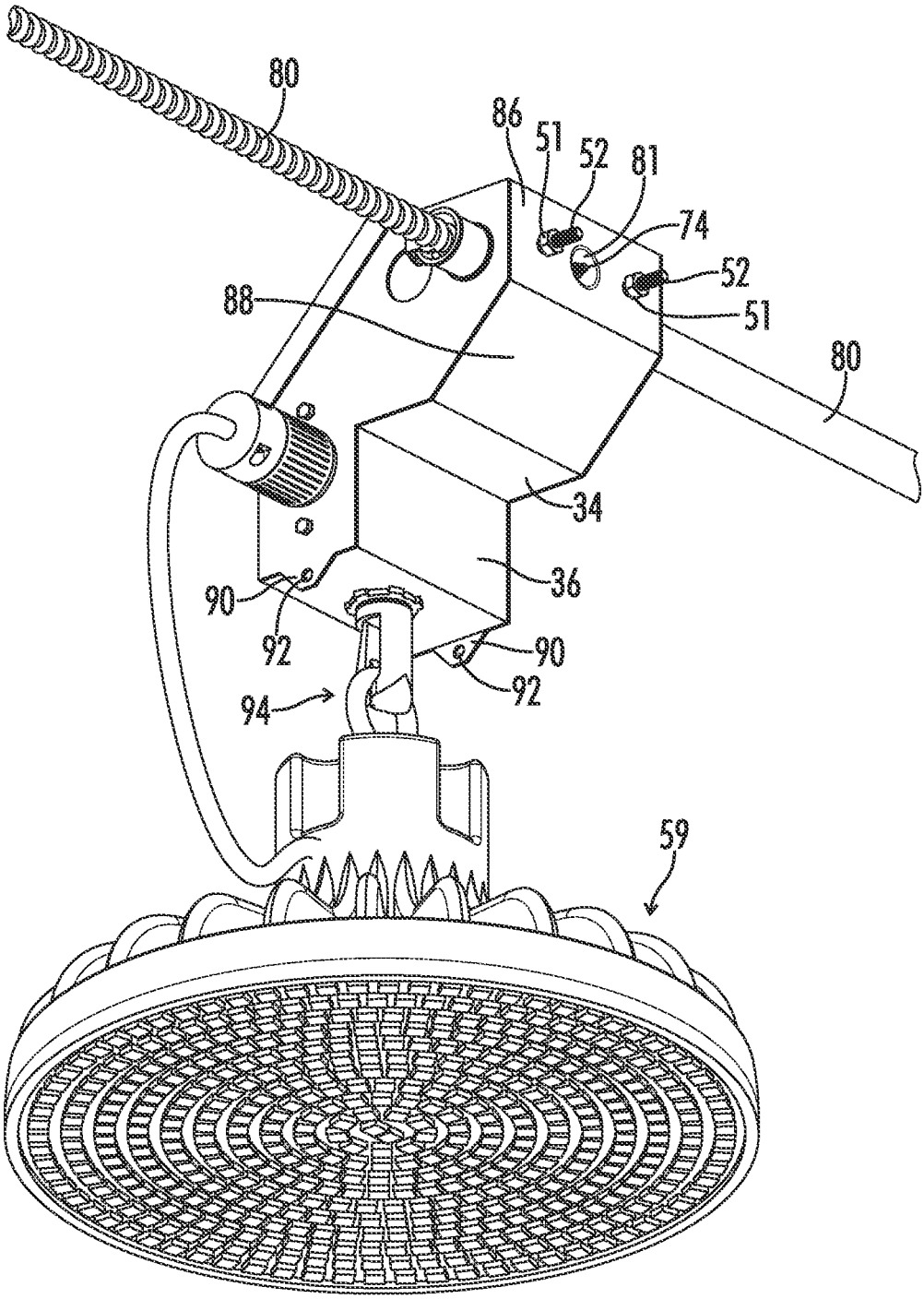
FIG. 13 illustrates a bottom perspective view of the mounting box, electrical wiring, UFO light and beam of FIG. 12.
Figure 14:
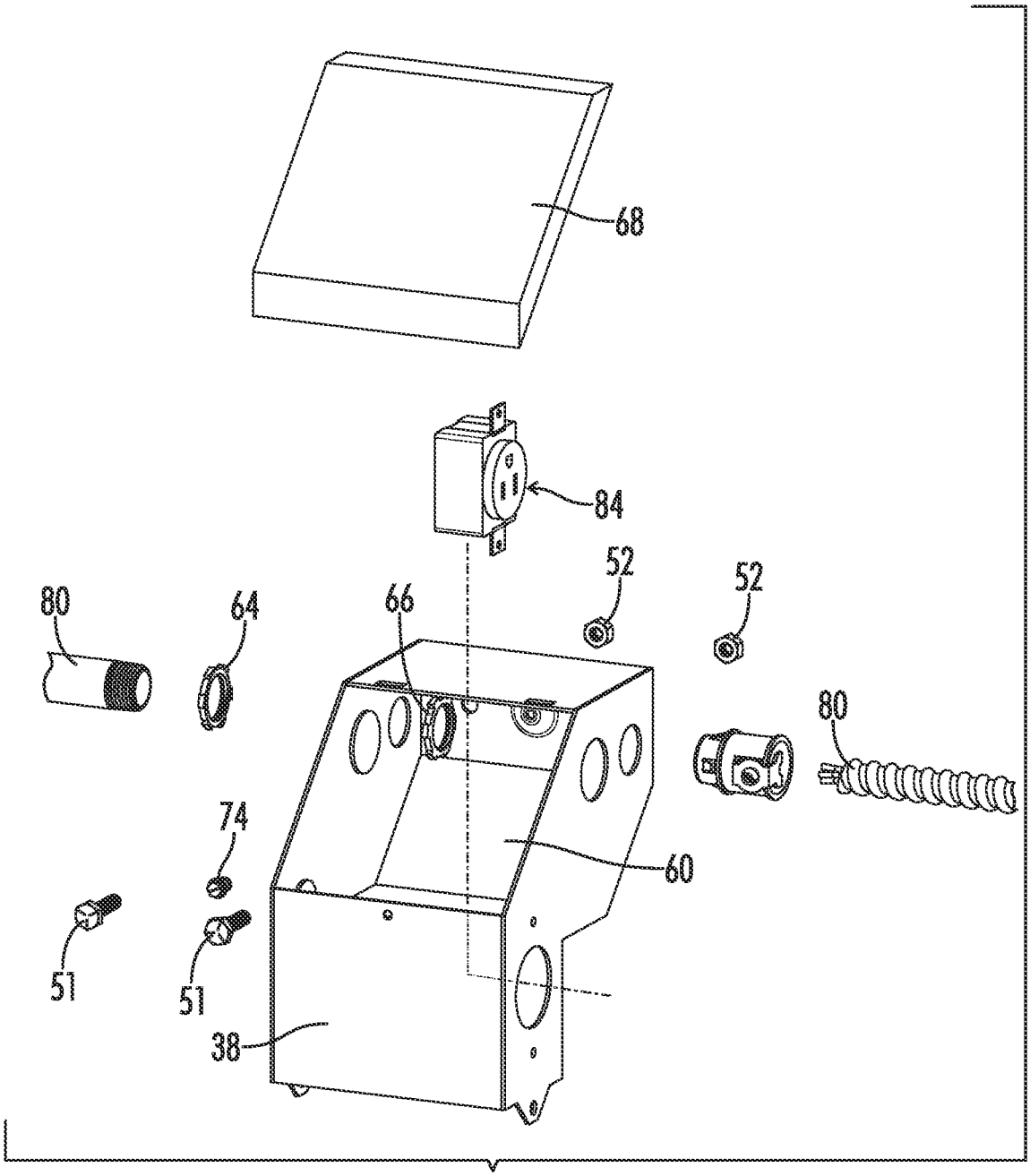
FIG. 14 illustrates an exploded perspective view of the mounting box and electrical wiring of FIG. 13.
Figure 15:
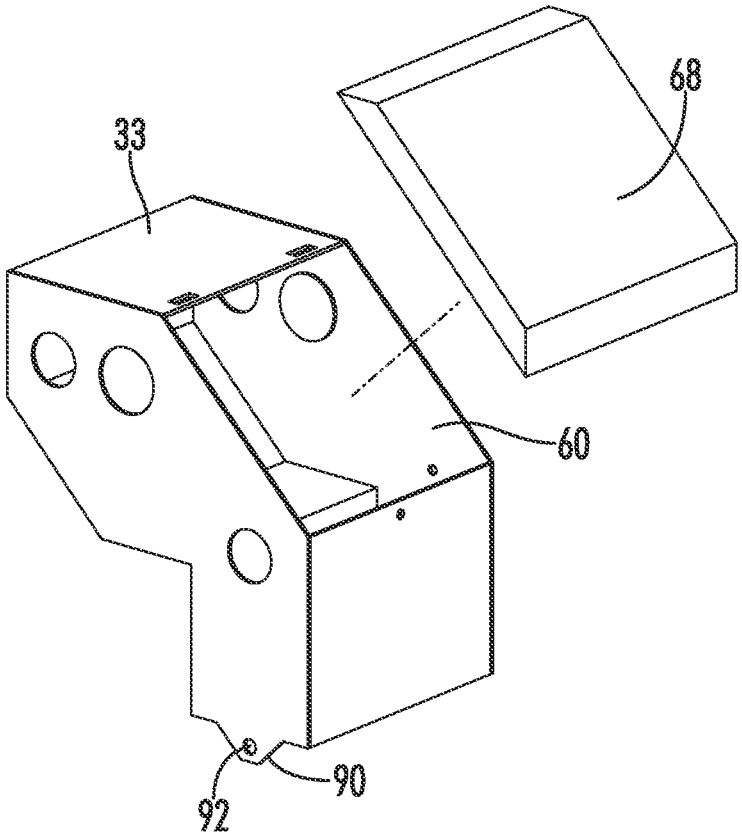
FIG. 15 illustrates a perspective view of the mounting box of FIG. 11 with the roof removed.
Figure 19:
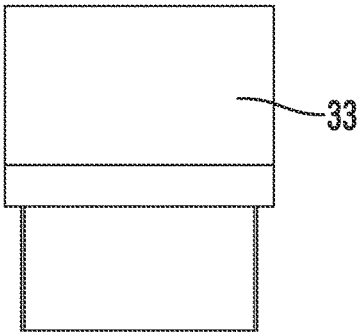
FIG. 19 illustrates a top plan view of the mounting box of FIG. 11.
Figure 17:
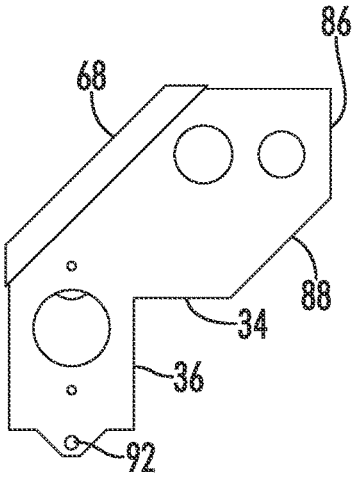
FIG. 17 illustrates a side elevation view of the mounting box of FIG. 11.
Figure 16:
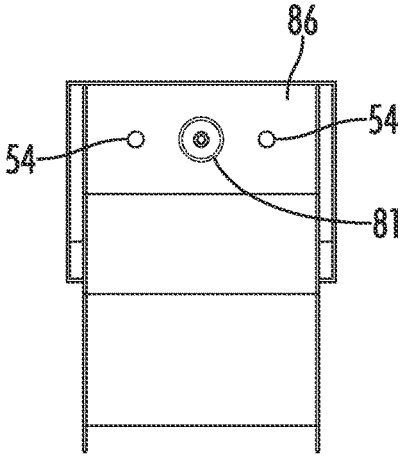
FIG. 16 illustrates a front elevation view of the mounting box of FIG. 11.
Figure 18:
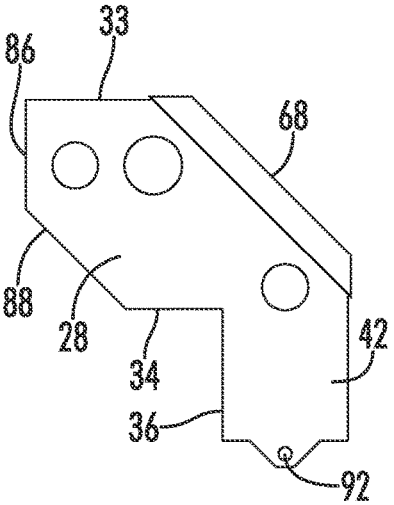
FIG. 18 illustrates another side elevation view of the mounting box of FIG. 11.
Figure 20:
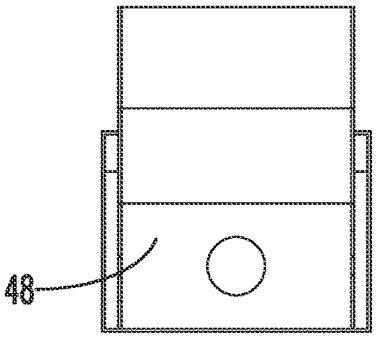
FIG. 20 illustrates a bottom plan view of the mounting box of FIG. 11.
Figure 21:
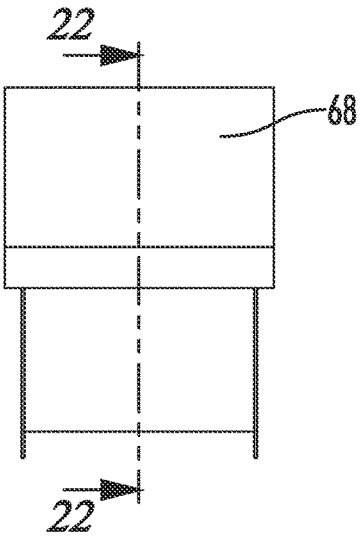
FIG. 21 illustrates a rear elevation view of the mounting box of FIG. 11.

Optionally, the lower portion bottom side 48 is connected to a light bulb 59. For example, a light bulb socket 58 may extend generally downwardly from the lower portion bottom side 48 to power and receive a light bulb 59. Different variations of light bulbs 59 may be used with light bulb socket 58. In an exemplary embodiment, the light bulb 59 is an LED light bulb not requiring an electrical ballast. The lower portion bottom side 48 may include a socket hole 56 and additional lateral hole 70 for fasteners, wires, and the like. Alternatively, as shown in FIG. 12, for example, a bulb fastener 94 may connect the bulb 59 to the lower portion bottom side 48. In still further embodiments, the box 10 is connected to another device other than a light bulb 59, such as a heater, fan, alarm, camera.

Figure 11:
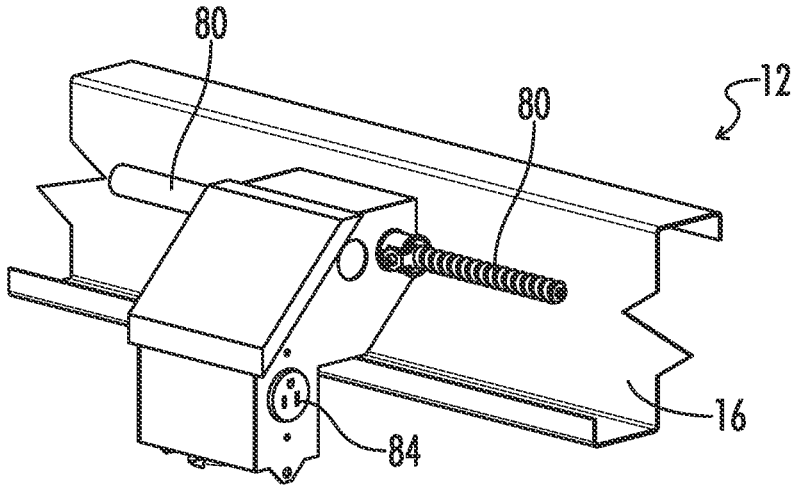
FIG. 11 illustrates a perspective view of a mounting box of another embodiment of the present invention attached to a beam of a building.

Optionally, the box 10 includes an electrical outlet 84. Optionally, the electrical outlet 84 is located on a side of the box 10, as best seen in FIG. 11. Alternately, the electrical outlet 84 may be in the box interior 60.

Figure 22:
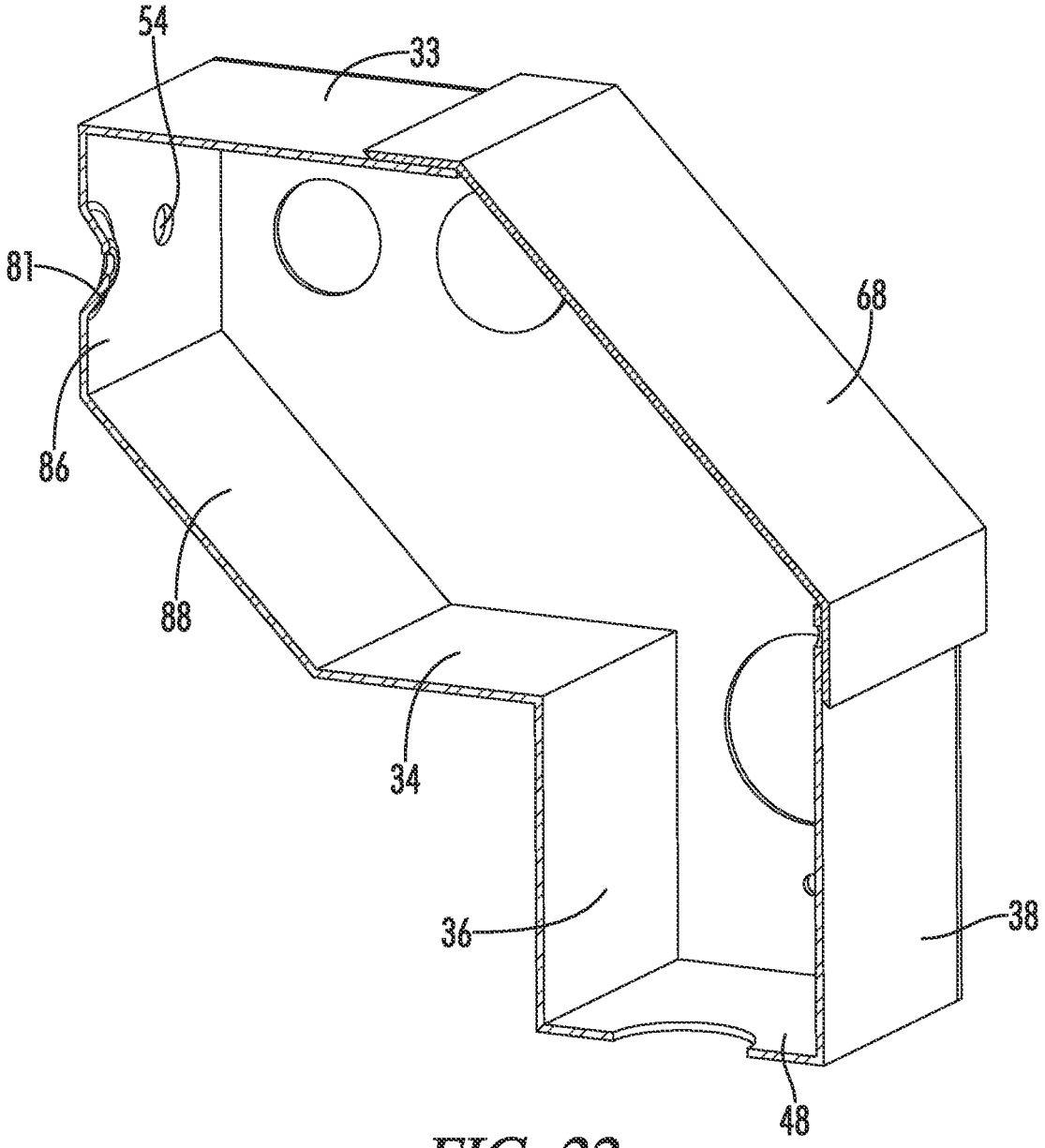
FIG. 22 illustrates a cross-sectional view of the mounting box of FIG. 11 taken along the line 22-22 of FIG. 21.
Figure 23:
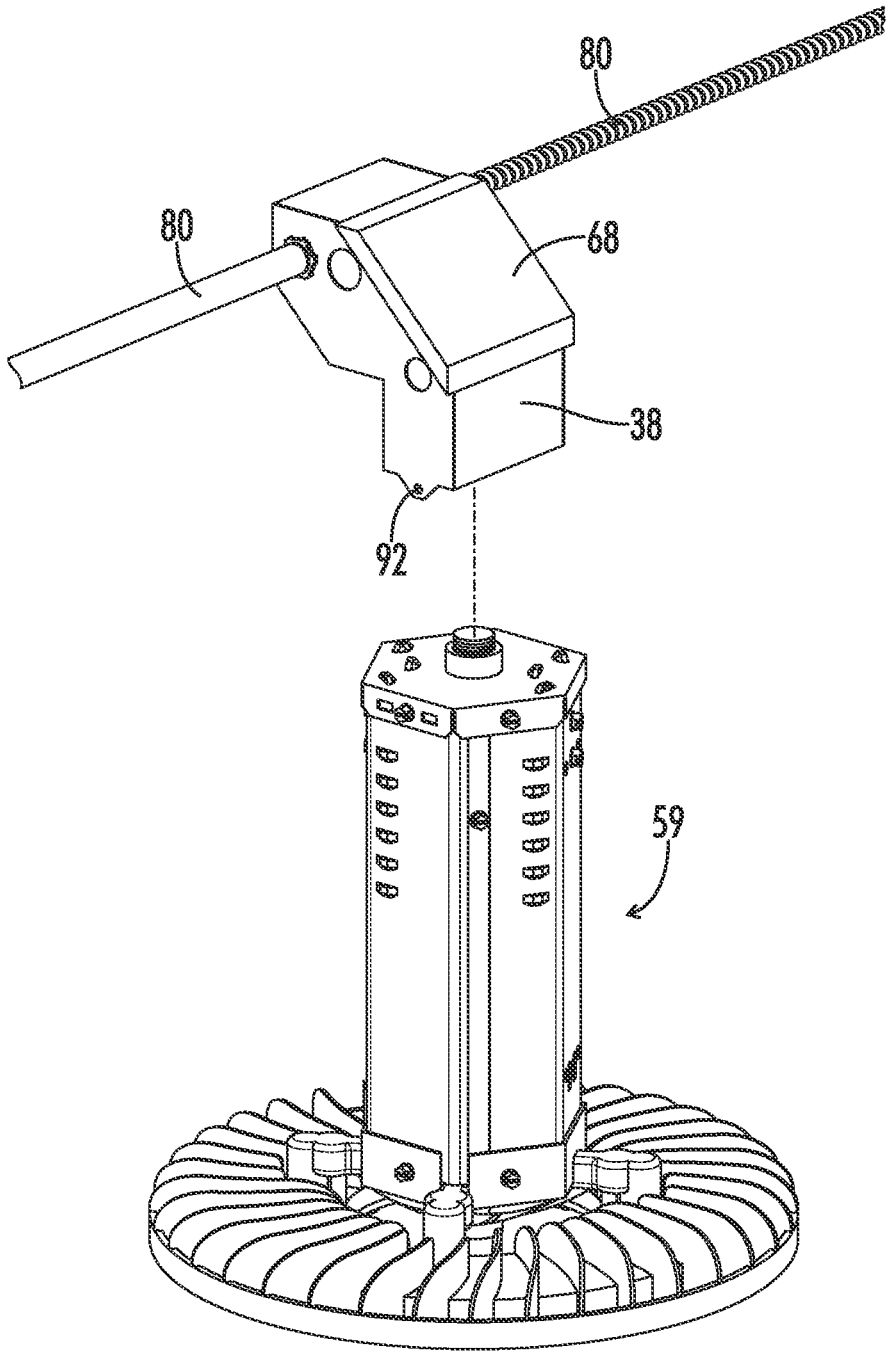
FIG. 23 illustrates a perspective view of the mounting box and electrical wiring of FIG. 11 with a high bay light attached to the lower portion bottom side of the mounting box.

Optionally, as shown in FIGS. 11-23 the upper portion front side 22 further comprises a perpendicular segment 86 angled at an angle of approximately 90 degrees relative to the upper portion top side 33 and an angled segment 88 angled at an angle of between about 10 degrees and 80 degrees relative to the upper portion top side 33 and connected to the upper portion bottom 34. Optionally, as shown in FIGS. 11-23, the angled segment 86 is parallel to the slanted roof 68. Optionally, the perpendicular segment 86 comprises the beam fastener hole 54, as shown in FIG. 22 for example. and the angled segment 86 confronts the beam lateral side 16, as shown in FIGS. 11 and 12 for example.

Figure 9:
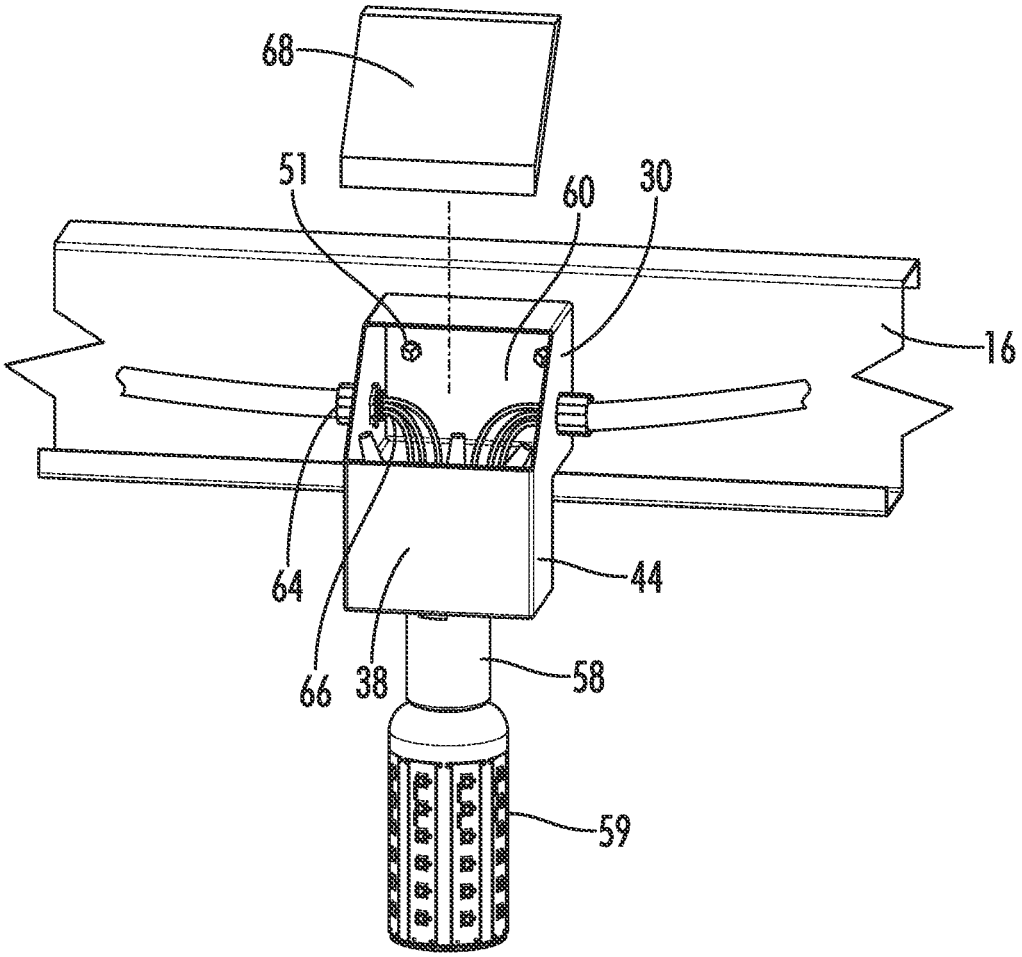
FIG. 9 illustrates a rear perspective view of the mounting box of FIG. 1.

Optionally, the box 10 is in the form of an electrical junction box to provide an enclosure housing electrical connections, to protect the connections and provide a safety barrier. For example, optionally, as best seen in FIG. 9, the box 10 may further include a box interior 60 comprising electrical wiring 80 powering the light bulb socket 58. Optionally, the upper portion left side 28 and the upper portion right side 30 may each include a wire hole 62. Optionally, wire hole threaded insert 64 and wire hole washer 66 may be used in conjunction with wire holes 62 so that electrical wiring 80 may pass through the holes 62 (more particularly through the hollow interiors of wire hole threaded inserts 64) in the upper portion left side 28 and upper portion right side 30 and to the light bulb socket 58 to power the light bulb socket 58. (Wire hole threaded insert 64 and wire hole washer 66 are not shown in FIGS. 4-6 and 10 for clarity). Alternatively, in an embodiment not shown, the lower portion left side 42 and the lower portion right side 44 each may each include a wire hole 62 and the electrical wiring 80 may pass through holes 62 in the lower portion left side 42 and lower portion right side 44.

Optionally, as best seen in FIGS. 4-7, the upper portion front side 22 and lower portion front side 36 each may be generally flat. Optionally, the upper portion rear side 24 may include removable access panel (e.g., a slanted roof 68) to facilitate assembly of the fasteners and wiring described herein for example. Optionally, the slanted roof 68 may be at an angle of between about 10 degrees and 80 degrees relative to the upper portion front side 22. Optionally, the slanted roof 68 may be in the form of a removable plate.

Figure 10:
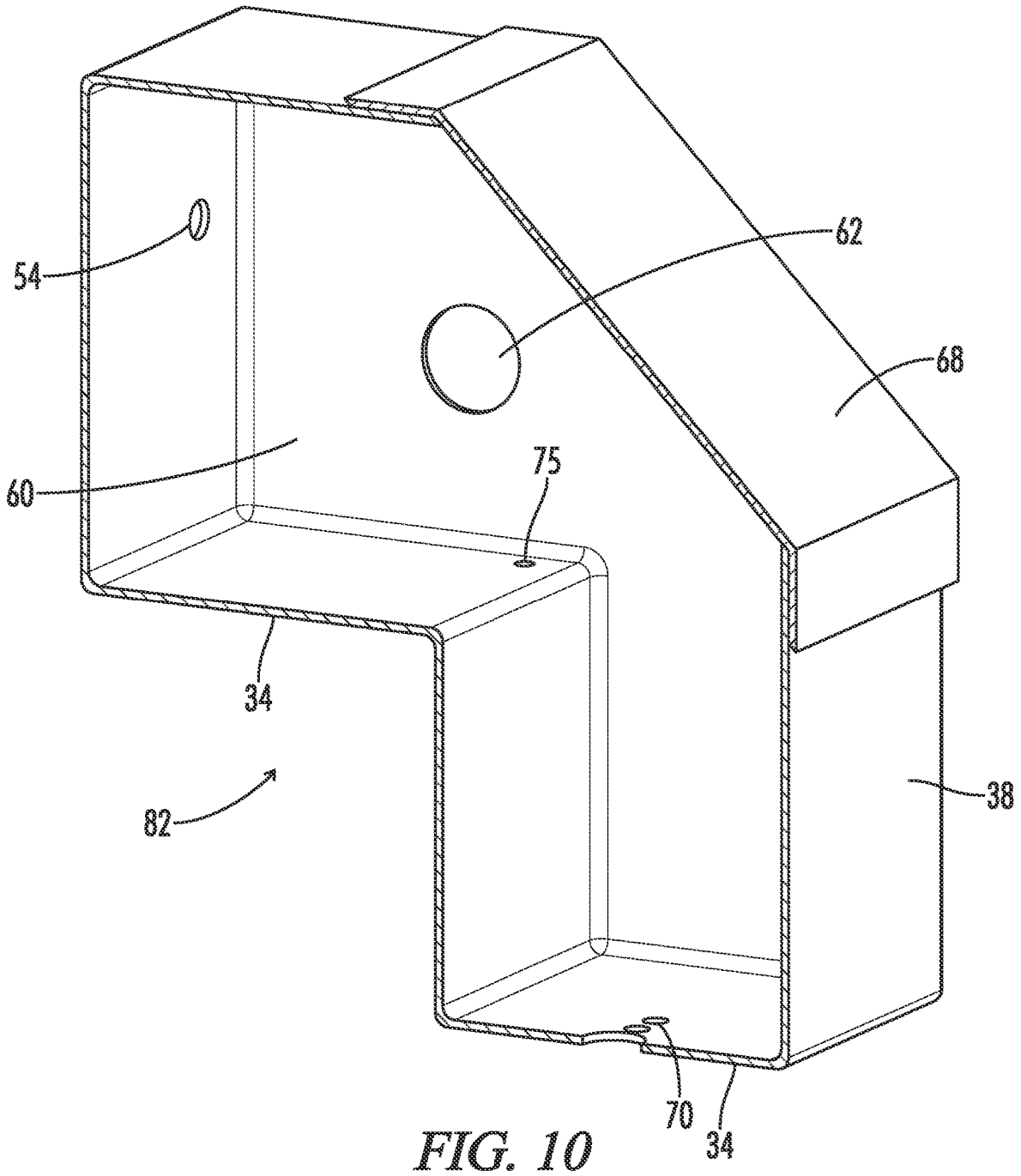
FIG. 10 illustrates a left side cross-sectional view of the mounting box of FIG. 1.

Optionally, as best seen in FIGS. 3 and 10, the box 10 may be generally L-shaped. Optionally, the box 10 may include a generally hollow interior 60. Optionally, the recess 82 may be generally rectangular in shape. Optionally, the box 10 may include at least one chamfered edge 72. Optionally, the box 10 may be in the form of a housing. Optionally, the box 10 may be comprised of metal. Box 10 may also be comprised of other suitable materials known in the art. Optionally, the box 10 includes one or more socket screws or other fasteners 76 for attaching the light bulb socket 58 to the lower portion bottom side 48. The box 10 may also include one or more grounds 74 attached to the electrical wiring 80. The ground 74 may be positioned through a ground hole 75. Optionally, the ground 74 may be positioned in a recess 81, which may be located on a side (e.g., the upper portion front side 36).

Optionally, as best seen in FIG. 3, the at least one generally circular fastener hole 54 may be configured to receive a fastener 50. Optionally, the fastener 50 may be perpendicular to the upper portion height 35. Optionally, the upper portion front side 22 may confront (and preferably engage) the beam lateral side 16, as shown in FIGS. 1-2 for example.

Optionally, as shown in the embodiment of FIGS. 11-23, the left side 42 of the lower portion bottom side 48 and the right side 44 of the lower portion bottom each include parallel ears/protrusions 90 that extend downwardly and include an ear/protrusion aperture 92. Optionally, a chain is positioned through the ear/protrusion apertures 92.

| Part List | |
|---|---|
| Box | 10 |
| Beam | 12 |
| Beam bottom side | 14 |
| Beam lateral side | 16 |
| Lip | 17 |
| Box upper portion | 18 |
| Box lower portion | 20 |
| Upper portion front side | 22 |
| Upper portion rear side | 24 |
| Upper portion width | 26 |
| Upper portion left side | 28 |
| Upper portion right side | 30 |
| Upper portion length | 32 |
| Upper portion top side | 33 |
| Upper portion bottom side | 34 |
| Upper portion height | 35 |
| Lower portion front side | 36 |
| Lower portion rear side | 38 |
| Lower portion width | 40 |
| Lower portion left side | 42 |
| Lower portion right side | 44 |
| Lower portion length | 46 |
| Lower portion bottom side | 48 |
| Beam fastener | 50 |
| Beam bolt | 51 |

-continued

| Part List | |
|---|---|
| Beam washer | 52 |
| Beam fastener hole | 54 |
| Light bulb socket hole | 56 |
| Light bulb socket | 58 |
| Light bulb | 59 |
| Box interior | 60 |
| Wire hole | 62 |
| Wire threaded insert | 64 |
| Wire hole washer | 66 |
| Slanted roof | 68 |
| Lateral holes | 70 |
| At least one chamfered edge | 72 |
| Ground | 74 |
| Ground hole | 75 |
| Socket screws | 76 |
| Electrical wiring | 80 |
| Ground recess | 81 |
| Recess | 82 |
| Electrical outlet | 84 |
| Perpendicular segment | 86 |
| Angled segment | 88 |
| Ear/protrusions | 90 |
| Ear/protrusion holes | 92 |
| Light fastener | 94 |

Having now described the invention in accordance with the requirements of the patent statutes, those skilled in the art will understand how to make changes and modifications to the disclosed embodiments to meet their specific requirements or conditions. Changes and modifications may be made without departing from the scope and spirit of the invention. In addition, the steps of any method described herein may be performed in any suitable order and steps may be performed simultaneously if needed.

Terms of degree such as "generally", "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

The invention claimed is:

1. A method of mounting a box to a beam of a building, the beam comprising a beam lateral side and a beam bottom side, the method comprising the steps of:

a) providing a box comprising an interior, an upper portion and a lower portion, the upper portion comprising an upper portion front side, an upper portion rear side, an upper portion width extending from the upper portion front side to the upper portion rear side, an upper portion left side, an upper portion right side, an upper portion length extending from the upper portion left side to the upper portion right side and generally perpendicular to the upper portion width, an upper portion top side, an upper portion bottom side, an upper portion height extending from the upper portion top side to the upper portion bottom side and generally perpendicular to the upper portion width and length, the lower portion comprising a lower portion front side, a lower portion rear side, a lower portion width extending from the lower portion front side to the lower portion rear side, a lower portion left side, a lower portion right side, a lower portion length extending from the lower portion left side to the lower portion right side and generally perpendicular to the lower portion width, and a lower portion bottom side located below the upper portion bottom side, wherein the lower portion front side is indented relative to the upper portion front side;

wherein the upper portion bottom side and the lower portion front side form a i) corner having an angle of approximately 90 degrees and ii) a recess; and further wherein a side of the box further comprises a removable access panel leading to the box interior;

b) positioning the upper portion front side so that the upper portion front side faces the beam lateral side; and c) attaching the box to the beam using a fastener.

2. The method of claim 1 wherein the upper portion front side comprises a generally circular fastener hole and wherein step c) comprises attaching the upper portion front side to the beam lateral side by positioning the fastener through the generally circular fastener hole and into the beam lateral side.

3. The method of claim 1 wherein the lower portion bottom side is connected to a light bulb socket.

4. The method of claim 3 wherein the light bulb socket extends generally downwardly from the lower portion bottom side.

5. The method of claim 3 wherein the method further comprises placing a light bulb in the light bulb socket.

6. The method of claim 3 wherein the box further comprises a box interior comprising electrical wiring powering the light bulb socket.

7. The method of claim 6 wherein the upper portion left side and the upper portion right side each comprise a hole and further wherein the electrical wiring passes through the holes in the upper portion left side and upper portion right side and to the light bulb socket.

8. The method of claim 6 wherein the lower portion left side and the lower portion right side each comprise a hole and further wherein the electrical wiring passes through the holes in the lower portion left side and lower portion right side.

9. The method of claim 1 wherein the box further comprises an electrical outlet.

10. The method of claim 9 wherein the electrical outlet is located in an interior of the box.

11. The method of claim 9 wherein the electrical outlet is located on a side of the box.

12. The method of claim 1 wherein the upper portion front side and lower portion front side are generally flat.

13. The method of claim 1 wherein the upper portion rear side comprises a slanted roof, the slanted roof angled at an angle of between about 10 degrees and 80 degrees relative to the upper portion top side.

14. The method of claim 13 wherein the slanted roof comprises the removable access panel.

15. The method of claim 1 wherein the upper portion front side further comprises a perpendicular segment angled at an angle of approximately 90 degrees relative to the upper portion top side and an angled segment angled at an angle of between about 10 degrees and 80 degrees relative to the upper portion top side and connected to the upper portion bottom.

16. The method of claim 15 wherein the upper portion rear side comprises a slanted roof, the slanted roof angled at an angle of between about 10 degrees and 80 degrees relative to the upper portion top side and further wherein the angled segment is parallel to the slanted roof.

17. The method of claim 1 wherein the box is generally L-shaped.

18. The method of claim 1 wherein the box comprises a generally hollow interior.

19. The method of claim 1 wherein the recess is generally rectangular in shape.

20. The method of claim 1 wherein the lower portion bottom side comprises a hole.

21. The method of claim 1 wherein the box comprises at least one chamfered edge.

22. The method of claim 1 wherein the box is in the form of a housing.

23. The method of claim 1 wherein the box is comprised of metal.

24. The method of claim 1 wherein the method further comprises joining a light bulb to the lower portion bottom side.

25. The method of claim 1 wherein the upper portion bottom rests on the beam after step c).

26. The method of claim 1 wherein the left side of the lower portion bottom side comprises a left side ear/protrusion extending downwardly comprising a left side ear/protrusion aperture and further wherein the right side of the lower portion bottom side further comprises a right side ear protrusion extending downwardly and comprising a right side ear/protrusion aperture, the right side ear/protrusion parallel to the left side ear/protrusion.

27. The method of claim 1 wherein the box further comprises a ground and at least one electrical wire connected to the ground.

28. The method of claim 27 wherein the ground is located in a side.

* * * * *